United States Patent [19]

Oliver

[11] Patent Number: 4,723,427

[45] Date of Patent: Feb. 9, 1988

[54] SYMMETRICAL SIDE BAR LOCK AND KEY THEREFOR

[75] Inventor: Roy N. Oliver, Salem, Va.

[73] Assignee: Medeco Security Locks Inc., Salem, Va.

[21] Appl. No.: 842,645

[22] Filed: Mar. 21, 1986

[51] Int. Cl.[4] ..... E05B 27/00

[52] U.S. Cl. ..... 70/364 A; 70/366; 70/362; 70/392; 70/409; 70/419; 70/378

[58] Field of Search ..... 70/362–366, 70/376–378, 392, 406, 407, 409, 419–421

[56] References Cited

U.S. PATENT DOCUMENTS

| | | | |
|---|---|---|---|
| Re. 30,198 | 1/1980 | Oliver et al. | 70/364 |
| 464,579 | 12/1891 | Mouat | 70/364 A |
| 2,022,070 | 11/1935 | Williams et al. | 70/364 A X |
| 2,023,847 | 12/1935 | Liss | 70/378 X |
| 2,087,554 | 7/1937 | Schoorel | 70/364 A |
| 2,890,582 | 6/1959 | Navarro | 70/364 R X |
| 3,287,945 | 11/1966 | Yulkowski | 70/406 X |
| 3,499,302 | 3/1970 | Spain et al. | 70/406 X |
| 3,499,303 | 3/1970 | Spain | 70/378 X |
| 3,987,654 | 10/1976 | Iaccino et al. | 70/378 X |
| 4,098,103 | 7/1978 | Raskevicius | 70/378 X |
| 4,196,604 | 4/1980 | Vorob | 70/419 X |
| 4,620,429 | 11/1986 | Quillen | 70/366 X |

*Primary Examiner*—Robert L. Wolfe
*Assistant Examiner*—Suzanne L. Dino
*Attorney, Agent, or Firm*—Bernard, Rothwell & Brown

[57] ABSTRACT

A cylinder lock of the type having twisting tumblers operated by a bitted key having at least one skew-cut bit provided with a side bar which is symmetrical with regard to a radius through a center of the key plug perpendicular to the plane of the key so that the side bar intersects not only slots in the twisting tumblers, but the profile of the key. The key has slots in its side face which extend perpendicular to its longitudinal axis.

9 Claims, 7 Drawing Figures

SYMMETRICAL SIDE BAR LOCK AND KEY THEREFOR

BACKGROUND OF THE INVENTION

1. Field of the Invention

This invention relates to improvements in cylinder locks of the type having dual locking mechanisms including tumblers and a side bar. More particularly this invention relates to improvements in twisting tumbler-side bar cylinder locks.

2. Prior Art

Medeco Security Locks, Inc. of Salem, Va., a wholly owned subsidiary of Hillenbrand Industries, Inc., makes and sells a twisting tumbler-side bar cylinder lock under the Medeco trademark. The Medeco cylinder lock is fully disclosed in U.S. Pat. No. Re. 30,198 reissued Jan. 29, 1980 and such disclosure is incorporated herein by reference.

In the Medeco lock the side bar which rests in a camming slot of the cylindrical shell must have its tumbler locking lugs positioned above a horizontal center line through a center of the plug since the side bar lugs or legs must be able to avoid interference with a proper bitted key when they move into the tumbler slots.

While the Medeco twisting tumbler-side bar cylinder lock has been a significant commercial success for a number of years, it, like many successful products, could be improved.

In the Medeco lock, because the side bar legs or lugs must avoid the key, they are of necessity of a small dimension in height and because the legs are asymetrical with regard to a radial line through the camming slot they will not bear the same forces in either direction. Also, if larger and symmetrically-positioned side bar legs or lugs could be used, the lock would offer more strength against forcing. However, if the side bar legs were made larger and the side bar were positioned symmetrically with regard to a horizontal line through the center of the plug, the side bar legs would intersect the key and not operate properly, thus rendering the lock inoperative.

SUMMARY OF THE INVENTION

This invention relates to improvements in the dual locking cylinder locks of the type including twisting tumblers and a side bar in which the side bar legs are symmetrical with a line through the center of the key plug perpendicular to the plane of the keyway so as to provide larger side bar legs which resist forcing equally in opposite directions and are stronger than legs which extend only to one side of the center line, combined with a unique key which allows operation of the cylindrical side bar by having vertical slots perpendicular to the longitudinal axis of the keyblade at the position of each tumbler.

BRIEF DESCRIPTION OF THE PREFERRED EMBODIMENT

Because the entire Medeco lock is so well known and is completely described in U.S. Pat. No. Re. 30,198, reissued Jan. 29, 1980 (the Medeco patent), a complete description of the lock cylinder will not be given, but only the improvements which are incorporated in this invention with regard to the symmetrical side bar and the unique key.

Figure 1:
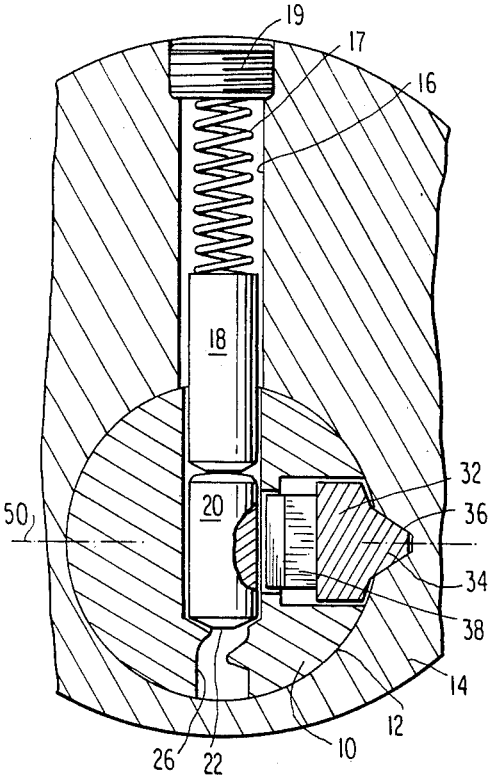
FIG. 1 is a transverse sectional elevation view taken through the improved lock of this invention at one tumbler pin location.

With reference to FIG. 1 there is shown a key plug 10 rotatable within a cylindrical bore 12 of a lock cylinder 14. The lock cylinder 14 has a plurality of tumbler holes 16 therein for reception of driver pins 18 which together with the tumblers 20 are biased downwardly by driver spring 17. A cap or other suitable means 19 closes each tumbler.

Each tumbler 20 has a chisel-shaped lower tip 22 as in the Medeco lock of U.S. Pat. No. Re. 30,198 and also has a slot 24 extending along one side of the tumbler as disclosed in the Medeco patent. A suitable keyway 26 of unique profile is provided horizontally into the plug. The keyway is preferably selected so that it is not of the same profile as any other commercial keyway so as to avoid the possibility of using different manufacturer's keys in the cylinder lock, as is known in the art. The key 28 has a key bit 30 for each tumbler slot and the key bits are either center cut, skew-cut right or skew-cut left as disclosed in the Medeco patent.

A side bar 32 extends substantially the length of the cylinder plug and includes a projection 34 on one side thereof for mating with a cam groove 36 in the shell. A plurality of lugs or legs 38 extend from the other side of the side bar toward the tumblers. There is a lug at each tumbler position. Springs 40 bias the side bar away from the tumblers and normally hold the projection 34 in the groove 36.

It should be noted that the keyway extends upwardly above a horizontal line 50 through the center of the plug and that the lugs or legs 38 of the side bar extend equally and symmetrically above and below the line 50 so that in normal operation with a prior art Medeco key when the lugs 38 move toward the slots 24 of the twisting tumbler, they would intersect the key. The line 50 is perpendicular to a plane of the keyway and extends through the axis of rotation of the plug. The plane of the keyway is a vertical plane in the FIG. 2 position which extends through the center of the plug and the tumbler holes.

Figure 6:
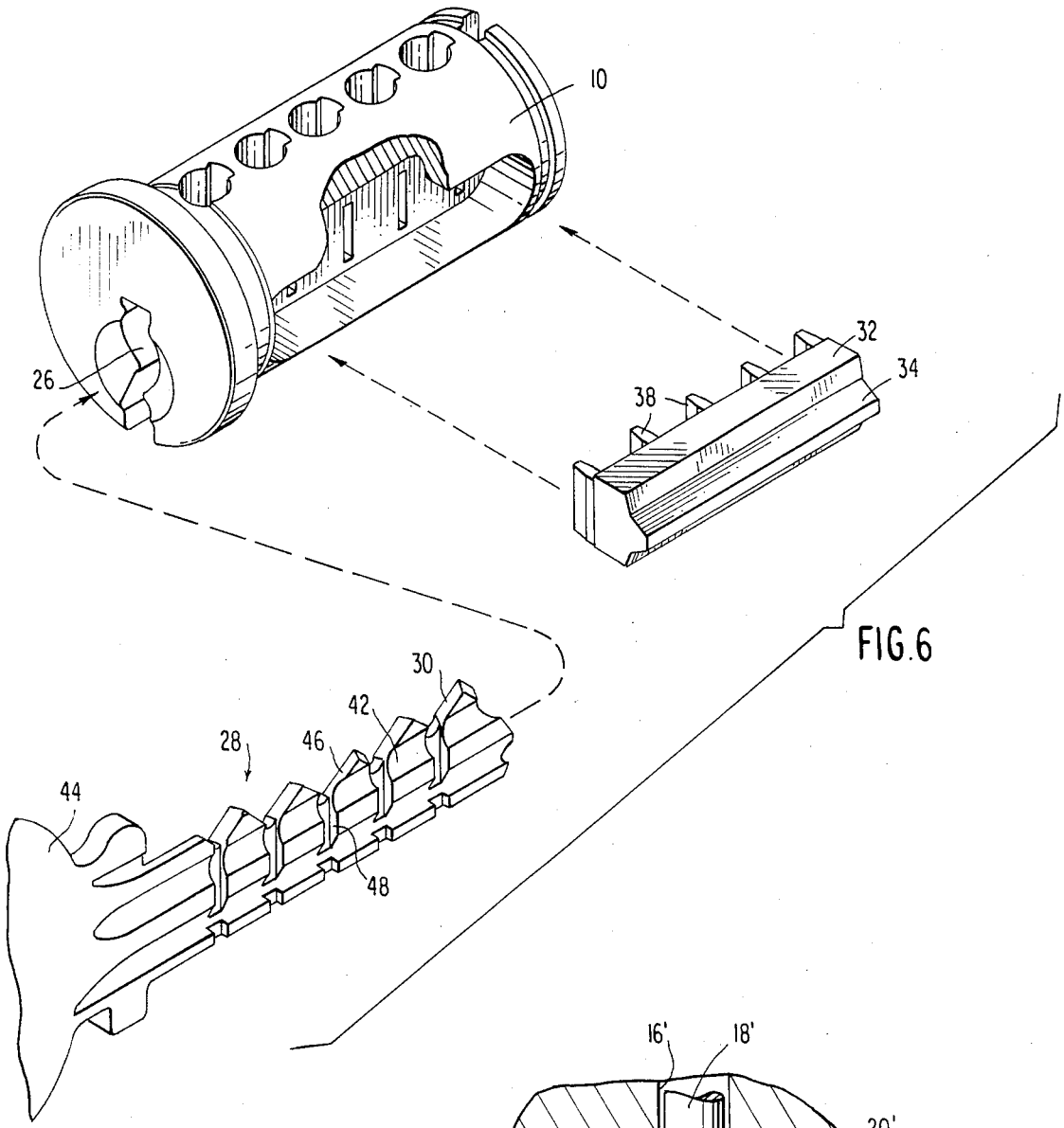
FIG. 6 is an exploded perspective view of an improved key of this invention with the cylinder plug and side bar of the lock.

The key used in this invention is shown more fully in FIG. 6. The key 28 has a blade portion 42 with a longitudinal axis and a bow 44 as is conventional. The key bits 30 on top of the blade portion 42 can include one or more skew-cut bits 46 which can be skewed in either direction as is known in the Medeco lock and one or more center cut bits.

Figure 4:
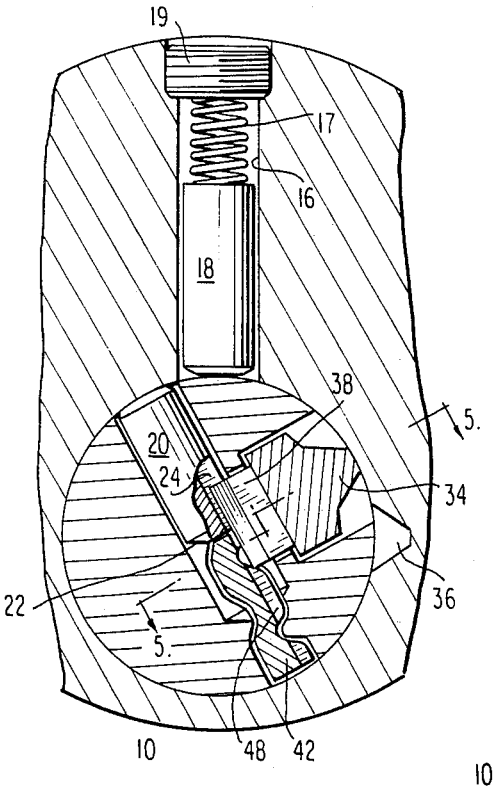
FIG. 4 is a transverse sectional view similar to FIG. 2 showing the lock plug turned toward an unlocking position.
Figure 5:
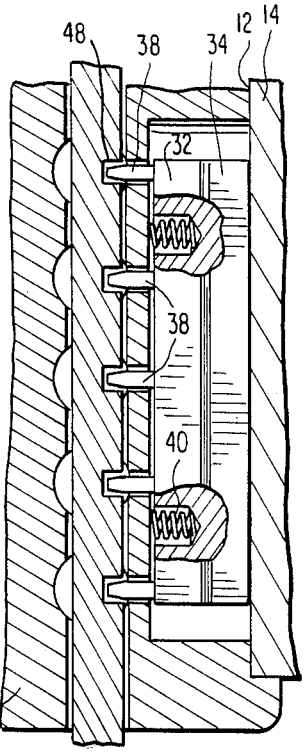
FIG. 5 is a sectional view taken along line 5—5 of FIG. 4.

The key blade 42 has a plurality of slots 48 in one side face thereof positioned adjacent to the bits and at the location of each tumbler. These slots 48 are on the same side of the key as the side bar. Each slot 48 extends into the profile of the keyway and the key blade can therefore accommodate the symmetrical lugs or legs 38 of the side bar as shown in FIGS. 4 and 5.

FIG. 1 shows the position of a tumbler when the lock is in a locked position with the side bar projection 34 in the groove 36 and the driver pin 18 blocking rotation of the key plug 10. This is the condition prior to insertion of a proper key.

Figure 2:
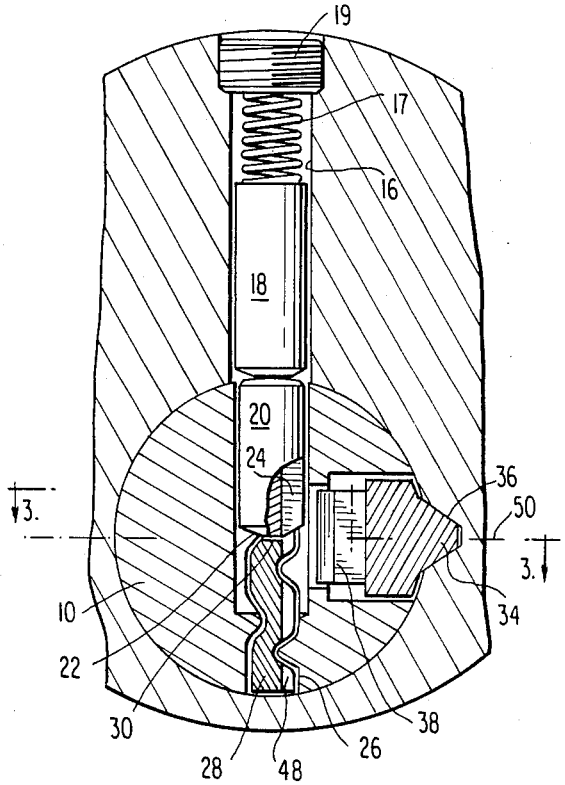
FIG. 2 is a transverse sectional elevation view similar to FIG. 1 illustrating the position of the tumbler upon insertion of a proper key.
Figure 3:
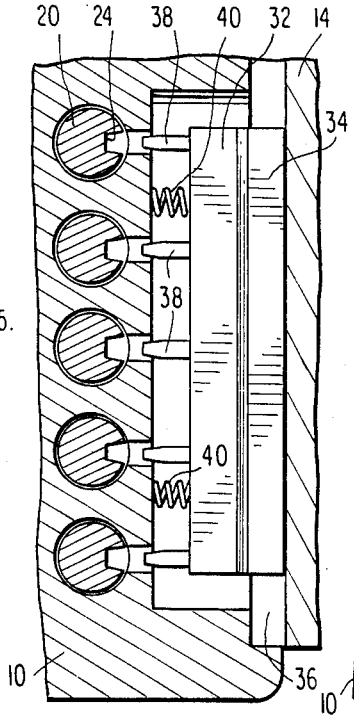
FIG. 3 is a sectional view taken along line 3—3 of FIG. 2.

FIG. 2 shows the situation at the time of insertion of a proper key and prior to the turning of the plug. The proper key 28 will twist each of the tumblers 20 by virtue of the chisel point on the tumblers and the straight or skew bits on the key so that the slots 24 on the tumblers line up with the side bar legs 38 as shown in FIG. 3. The side bar legs then have suitable space for movement to the left as shown in FIG. 3 upon turning of the key. When the key is turned the side bar projection 34 cams out of slot 36 as shown in FIG. 4 and moves inwardly to a position so that the tips of the legs 38 are accommodated by the slots 24 of the tumblers 20 and by the slots 48 of the keyblade 42 as shown in FIG. 5.

FIG. 6 shows the interaction of the key with its cross sectional profile fitting into the keyway in the cylindrical plug and the side bar removed from the plug but positionable therein.

Figure 7:
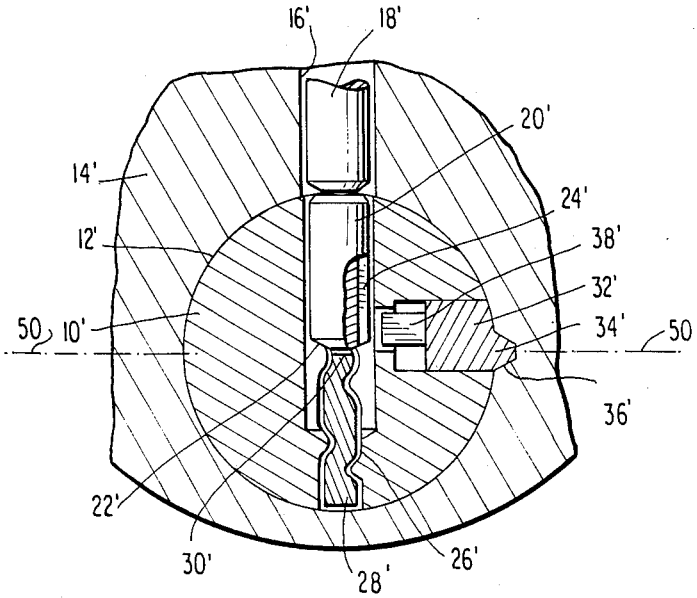
FIG. 7 PRIOR ART
FIG. 7 is a transverse sectional view of the prior art Medeco lock.

FIG. 7 shows the prior art Medeco lock with each reference numeral of the prior described parts indicated with a prime and showing the Medeco key inserted to twist and lift the tumbler so that the tumbler 20' is positioned at the shear line and the tumbler slot 24' is positioned to receive the lug 38' of the side bar 32'. However, the lug 38' of the side bar 32' is asymmetrical and is above a radius perpendicular to a plane of the keyway. That is, lug 38' is above line 50 because if it were to extend below line 50 it would intersect the keyway and the key and render the lock inoperable.

With this invention the side bar lugs are symmetrical on either side of a radius perpendicular to the plane of the key. Thus, the side bar lugs 38 can be wider to enhance interaction with the shell slot and provide the same action and resistance in either direction of rotation of the plug. Furthermore, with larger legs the legs are stronger and provide more resistance to forcing. Additionally, the unique construction requires a key with parallel slots so that one can be sure that a key with parallel slots fits a lock of the invention and enables the key to be better identified on a key ring.

What is claimed is:

1. In a cylinder lock of the type including a plurality of rotatable and reciprocal tumblers operable by a bitted key having a blade with at least one skew-cut bit, a rotatable cylindrical plug with a keyway for the key, the plug rotatable in a cylinder shell, and a side bar locking means, improvements in the side bar locking means comprising: the side bar locking means extending symmetrically to either side of a radius from a center of the cylindrical plug extending perpendicular to a plane of the keyway, and means allowing the side bar locking means to be movable to intersect the keyway upon rotation of the cylindrical plug.

2. In a cylinder lock and key combination of the type including a plurality of rotatable and reciprocal tumblers, a bitted key having a blade with at least one skew-cut bit for operating the lock, a cylindrical plug having a keyway for the key, the plug rotatable in a cylinder shell, and a side bar locking means, improvements in the side bar locking means and the key comprising; the side bar locking means extending symmetrically on either side of a line perpendicular to a plane of the keyway and extending through an axis of rotation of the cylindrical plug, the side bar locking means movable to intersect the keyway upon rotation of the cylindrical plug, and the blade of the bitted key being formed to accommodate movement of the side bar locking means when it intersects the keyway.

3. A cylinder lock and key combination as in claim 2 wherein the side bar locking means includes a plurality of projections and the key blade includes a plurality of depressions complementary in shape to the projections.

4. A cylinder lock and key combination of claim 3 wherein the projections are of generally rectangular post-like configurations and the depressions are generally of complementary slot-like configurations, and the projections extend perpendicular to a longitudinal axis of the key blade.

5. A cylinder lock comprising;

(a) a cylinder lock shell of generally cylindrical shape having a plurality of spaced tumbler-pin-containing holes therein perpendicular to a longitudinal axis of the cylinder, a cylindrical plug opening offset from the axis of the cylinder, and a side bar slot symmetrically offset from the cylinder plug opening, (b) a plurality of rotatable pin tumblers, one in each of the tumbler holes, the tumblers having a configuration to receive a side bar projection, (c) a side bar having a plurality of tumbler-contacting projections, one for each of the tumblers on one face thereof, and a camming projection on the other face for mating with the side bar slot in the cylindrical shell, (d) a cylinder plug having an axial keyway of predetermined cross section, a plurality of tumbler holes, and a slot for receiving the side bar, and (e) the side bar receiving slot extending symmetrically on both sides of a radial line extending through the axis of the cylinder plug and perpendicular to a plane of the keyway, the arrangement being such that upon insertion of a proper key in the keyway the tumblers are twisted on their axis and move axially so that the key can turn the plug, and the camming projection on the side bar cams against the side bar slot to move the tumbler-contacting projections on the side bar into contact with the tumbler and into contact with a depression in a proper key to allow continued rotation of the plug.

6. A dual locking cylinder lock of the type having twisting tumblers and a cooperating side bar, the cylinder lock comprising;

(a) a cylinder lock shell having a plurality of tumbler-pin-containing holes therein, a cylinder plug opening, and a side bar slot, (b) a plurality of twisting pin tumblers in the tumbler holes of the cylinder lock shell, the tumblers having a configuration to receive a side bar projection, (c) a cylinder plug having an axial keyway of predetermined cross section, the cylinder plug insertable into the cylinder plug opening in the cylinder shell, the cylinder plug also having a plurality of tumbler holes and a slot for the side bar, the slot for the side bar extending symmetrically to both sides of a horizontal radial line extending through the axis of the cylinder plug, and (d) a side bar having a tumbler-containing projection means on one face thereof and a camming projection means on the other face thereof mating with the side bar slot in the cylinder lock shell, the side bar projection means extending radially inwardly so as to intersect the keyway section of the cylinder plug and also extending symmetrically on opposite sides of a radius from the axis of the plug to the side bar projection.

7. A cylinder lock as defined in claim 6 wherein the projection means on the side bar lock are generally post-like projections.

8. A cylinder lock as defined in claim 7 wherein the post-like projections are generally rectangular in configuration.

9. A key for a cylinder lock as defined in claim 8 comprising a key member having a blade section with side faces and a top and bottom face, the blade section having a cross section corresponding in configuration to the keyway, at least one skew-cut bit and one straight-cut bit on the top surface of the blade section, and a plurality of grooves on a side surface of the keyway, the grooves being complementary in configuration to the post-like projections on the side bar and corresponding in number thereto.

* * * * *